US008869658B2

(12) United States Patent
Chou

(10) Patent No.: US 8,869,658 B2
(45) Date of Patent: Oct. 28, 2014

(54) MULTI-FUNCTION TOOL STRUCTURE

(75) Inventor: Yi-Chiu Chou, Taichung (TW)

(73) Assignee: Re-Dai Precision Tools Co., Ltd., Taiping Dist., Taichung (TW)

( * ) Notice: Subject to any disclaimer, the term of this patent is extended or adjusted under 35 U.S.C. 154(b) by 378 days.

(21) Appl. No.: 13/480,711

(22) Filed: May 25, 2012

(65) Prior Publication Data

US 2012/0304830 A1 Dec. 6, 2012

(30) Foreign Application Priority Data

Jun. 2, 2011 (TW) ..... 100209997 U

(51) Int. Cl.
*B25B 23/16* (2006.01)
*B25G 1/00* (2006.01)
*B25G 1/06* (2006.01)

(52) U.S. Cl.
CPC ..... *B25G 1/007* (2013.01); *B25G 1/066* (2013.01)
USPC ..... 81/177.8; 81/177.6; 81/177.7; 81/177.9; 403/96; 403/322.4

(58) Field of Classification Search
USPC ..... 81/177.6–177.9; 403/92, 94, 95, 96, 403/322.4; 7/168
See application file for complete search history.

(56) References Cited

U.S. PATENT DOCUMENTS

| | | | | | |
|---|---|---|---|---|---|
| 579,277 | A * | 3/1897 | Lord et al. | 403/96 |
| 2,097,361 | A * | 10/1937 | Bagley | 81/177.6 |
| 4,611,514 | A * | 9/1986 | Hyde | 81/60 |
| 5,207,755 | A * | 5/1993 | Ampian | 15/230.11 |
| 5,280,738 | A * | 1/1994 | Liou | 81/20 |
| 5,353,892 | A * | 10/1994 | Lu | 182/163 |
| 5,542,322 | A * | 8/1996 | Knox et al. | 81/177.6 |
| 5,620,272 | A * | 4/1997 | Sheng | 403/96 |
| 6,467,986 | B2 * | 10/2002 | Feng | 403/93 |
| 7,168,345 | B1 * | 1/2007 | Hsieh | 81/177.6 |
| 7,182,003 | B1 * | 2/2007 | Hsieh | 81/177.6 |
| 7,509,892 | B2 * | 3/2009 | Hsieh | 81/177.6 |
| 7,761,951 | B1 * | 7/2010 | O'Neal, Jr. | 15/230.11 |
| 8,230,766 | B2 * | 7/2012 | Chang | 81/177.8 |
| 2009/0241740 | A1 * | 10/2009 | Heagerty | 81/63.1 |
| 2011/0079113 | A1 * | 4/2011 | Johnson et al. | 81/60 |
| 2013/0269491 | A1 * | 10/2013 | Chang | 81/177.8 |

* cited by examiner

*Primary Examiner* — Bryan R Muller
(74) *Attorney, Agent, or Firm* — Charles E. Baxley

(57) ABSTRACT

In a multi-function tool structure, a body and a work rod are pivotally connected together and can form a folded and retracted state. Moreover, an elastically movable press button is disposed on the body and can link up a positioning pin movably inserted into the work rod. Thus, pressing the press button can release a lock between the work rod and the positioning pin so that the work rod is swingable, while releasing the press button can lock the positioning pin and the work rod together again. Thus, the work rod and the body can be folded and retracted to facilitate the storage and carrying. After the work rod is developed, it can form multiple included angles with respect to the body so that the requirements of different operation angles can be satisfied.

6 Claims, 9 Drawing Sheets

MULTI-FUNCTION TOOL STRUCTURE

BACKGROUND OF THE INVENTION

1. Field of the Invention

The invention relates to the technological field of a hand tool, and more particularly to a tool structure having a body and a work rod, which is pivotally connected to the body to form a folded state, or can be developed.

2. Related Art

A hand tool, such as a ratchet wrench, an adjustable wrench, a hammer, a saw or the like, is a tool that may be operated by the hands of the user. For example, in order to facilitate the user's operation and achieve the laborsaving object, the ratchet wrench has a body having an end portion formed with a work head, which can drive a workpiece or can be fit with a sleeve.

Actually, the body has a longer length and can enhance the laborsaving effect, but requires the larger space for storage and transportation. In addition, the convenience of operation is also decreased. On the contrary, if the length of the body is shorter, the user needs to increase the operation force.

Although various hand tools that can be folded and retracted have been developed in the market, these hand tools have the complicated structures or cannot effectively achieve the positioning in the operation.

SUMMARY OF THE INVENTION

A main object of the invention is to provide a multi-function tool structure, which has a length that can be changed according to the requirement, and can be adjusted to a specific angle so that the effects of saving the space and enhancing the operation convenience can be achieved.

To achieve the above-identified object, the invention provides a multi-function tool including a body, a retraction receptacle, a storage receptacle, a slide hole, a work rod, a press button, a compression spring, a positioning pin and a return spring. The retraction receptacle is formed on the body and has one end having an open structure having two sidewalls. The storage receptacle is formed on an outer surface of one of the sidewalls of the open structure. The slide hole is formed in the storage receptacle. The work rod disposed in the open structure has a rod portion and a head connected to one end of the rod portion. The rod portion has a development positioning hole and a retraction positioning hole. The press button is swingably mounted in the storage receptacle. The compression spring is disposed in the storage receptacle and has one end in contact with the press button. A combination of the positioning pin and the return spring is disposed in the slide hole. The positioning pin has one end in contact with the press button, and the other end inserted into the retraction positioning hole or the development positioning hole.

Thus, pressing the press button can release a lock between the positioning pin and the work rod, and make the work rod be retracted into the retraction receptacle of the body, or make the work rod and the body form a developed state; and further make the positioning pin be embedded into the retraction positioning hole or the development positioning hole to position the work rod.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE INVENTION

Figure 1:
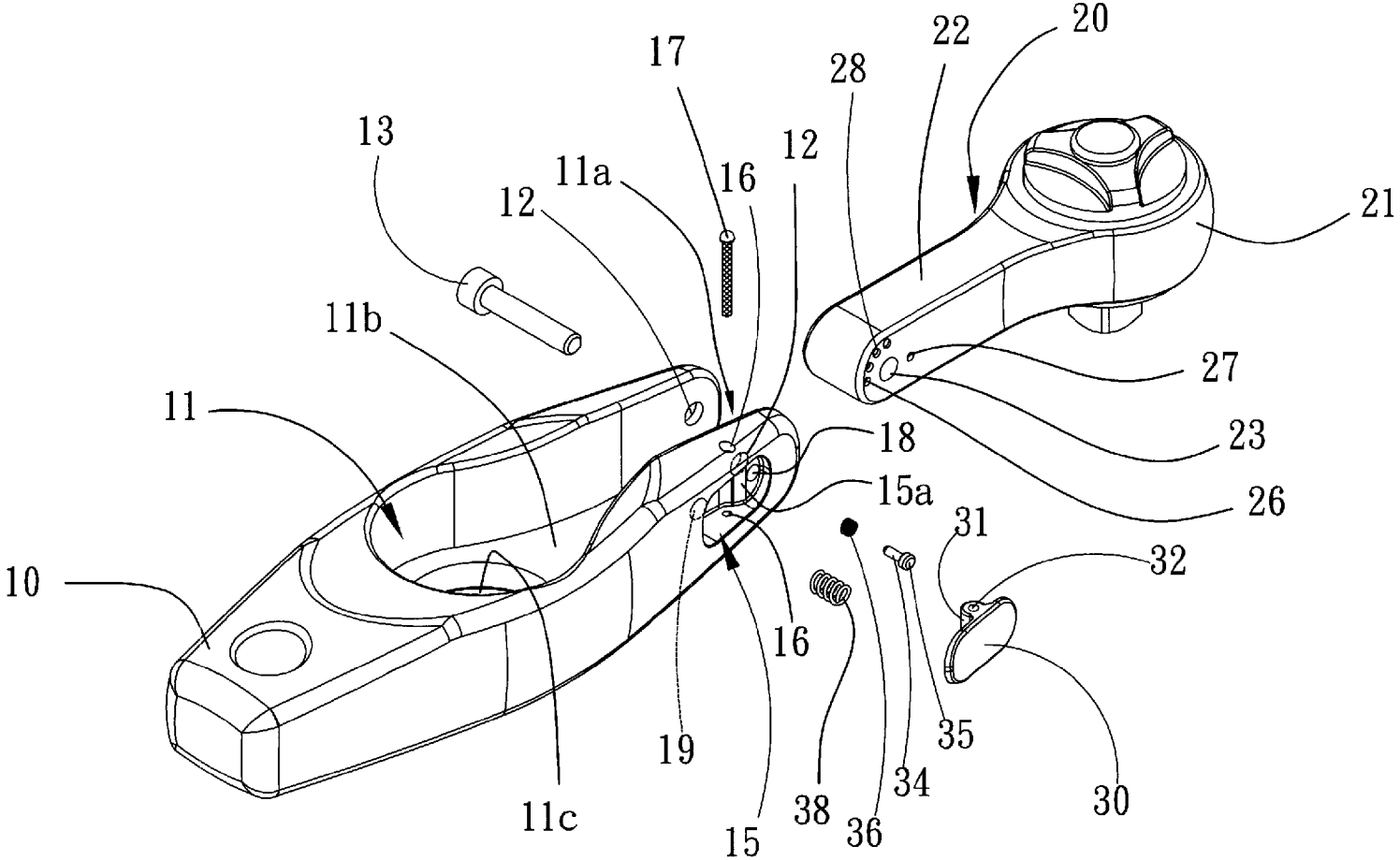
FIG. 1 is an exploded view of the invention.

The present invention will be apparent from the following detailed description, which proceeds with reference to the accompanying drawings, wherein the same references relate to the same elements.

It is to be specified that the references of "front", "rear", "left", "right", "top", "bottom", "horizontal" and "vertical" directions are provided for the convenience of description, and do not intend to restrict the invention and also do not intend to restrict the members thereof to any positional or spatial directions in the drawings of the embodiment(s) of the invention.

Referring to FIG. 1, the invention discloses a hand tool including a body 10 and a work rod 20 pivotally connected to the body 10, wherein the body 10 and the work rod 20 may be folded and retracted relatively to each other.

Moreover, the body 10 has a retraction receptacle 11, which has an opening facing upwards and accommodates the work rod 20. One end of the retraction receptacle 11 has an open structure 11*a*, and a bottom surface 11*b* of the retraction receptacle 11 has a through hole 11*c*. Each of two sidewall surfaces of the open structure 11*a* of the retraction receptacle 11 is formed with a locking hole 12.

Also, a storage receptacle 15 is formed on an outer surface of a sidewall surface of the open structure 11*a*, and a pair of positioning holes 16 are respectively formed on opposite wall surfaces of the storage receptacle 15. One of the positioning holes 16 has a penetrating structure. A bottom surface of the storage receptacle 15 has a bump portion 15*a*, a slide hole 18 and an accommodating slot 19 formed on the storage receptacle. The slide hole 18 is located at the bump portion 15*a*, and is a penetrating structure communicating with the open structure 11*a*.

The work rod 20 has a head 21 and a rod portion 22, wherein the head 21 is formed on one end of the rod portion 22. The head 21 may have a ratchet structure for driving or connecting to a sleeve. The rod portion 22 has a shaft hole 23, a development positioning hole 26, a retraction positioning hole 27 and a plurality of angle positioning holes 28. The retraction positioning hole 27 is disposed opposite the development positioning hole 26. The development positioning hole 26 and the angle positioning holes 28 may be located around the shaft hole 23, which is disposed between the development positioning hole 26 and the retraction positioning hole 27.

Figure 2:
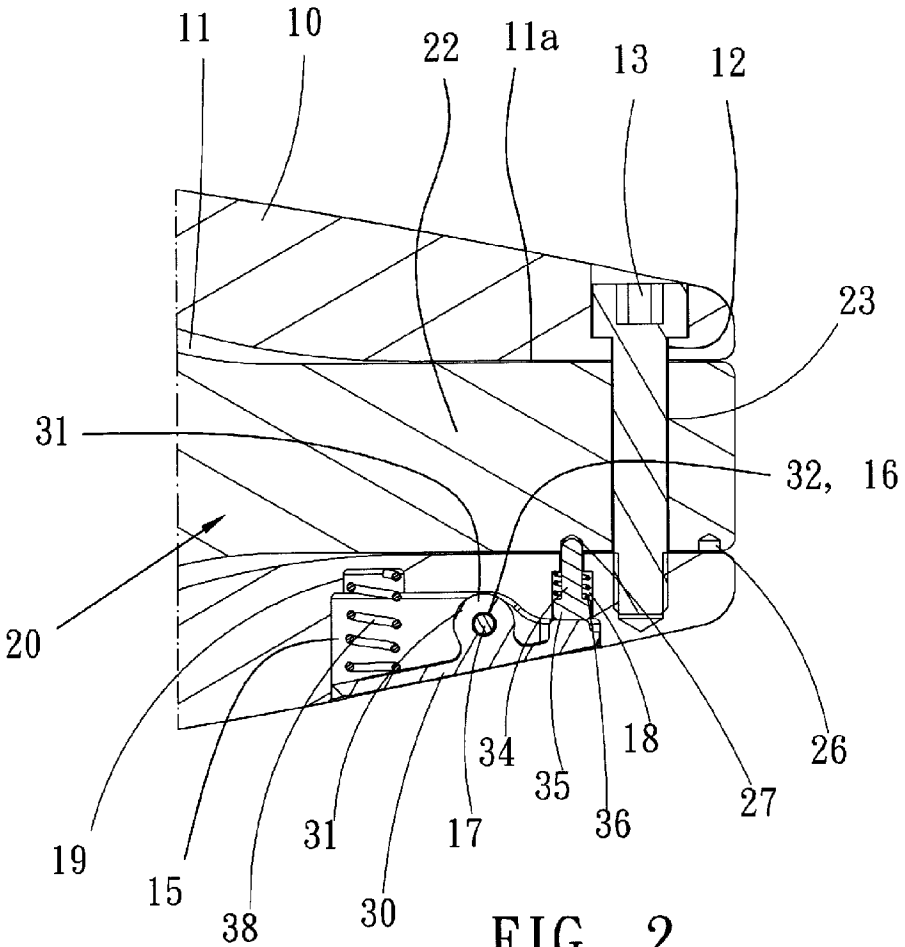
FIG. 2 is a schematically assembled illustration of the invention.

As shown in FIGS. 1 and 2, the rod portion 22 of the work rod 20 is assembled in the open structure 11*a*, and a pin 13 penetrates through the locking hole 12 and the shaft hole 23 so that the work rod 20 can be combined with the body 10.

Furthermore, a compression spring 38 is mounted in the accommodating slot 19. A combination of a positioning pin 34 and a return spring 36 is mounted in the slide hole 18. One end of the positioning pin 34 has a projection 35, which has a larger outer diameter and is for restricting the return spring 36.

A press button 30 has a pivot seat 31. A pivot hole 32 is formed on the pivot seat 31. The press button 30 is mounted on the storage receptacle 15, and a pivot rod 17 penetrates through the positioning hole 16 and the pivot hole 32 so that the press button 30 is combined with the body 10. One side of the press button 30 rests against the compression spring 38, and the other side of the press button 30 rests against the positioning pin 34.

Figure 3:
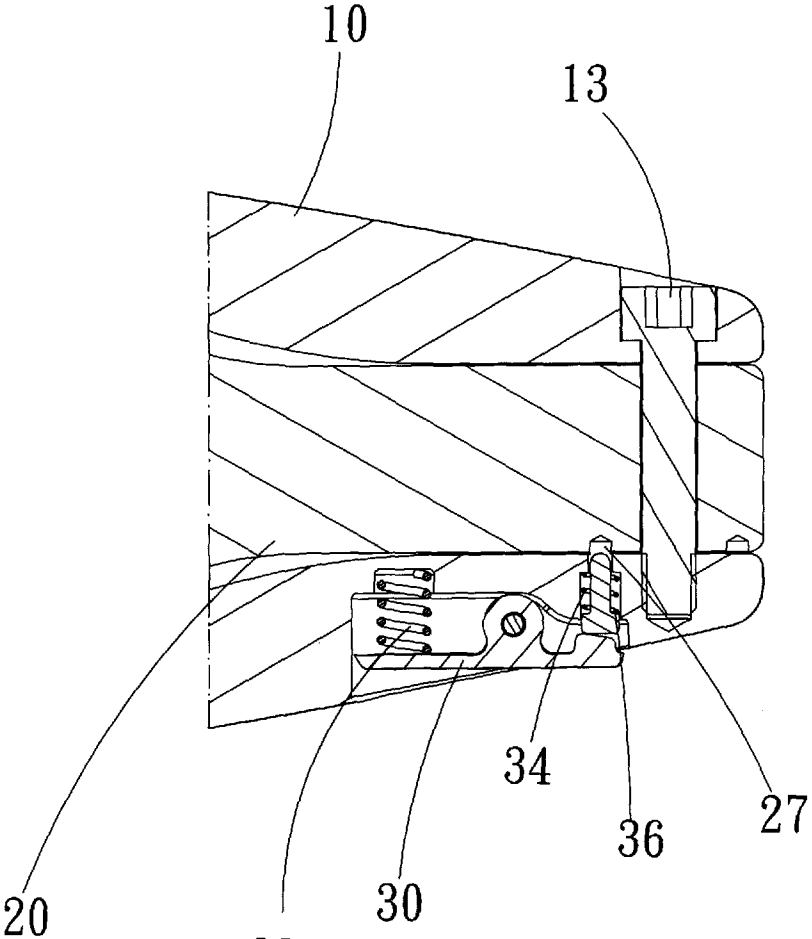
FIG. 3 is a schematic illustration showing the operation of pressing the press button of the invention.

As shown in FIG. 3, when one side of the press button 30 is forced to press the compression spring 38, the positioning pin 34 can encounter the action of the return spring 36 and move away from the rod portion 22 of the work rod 20. For example, the positioning pin 34 is moved away from the retraction positioning hole 27 shown in the drawing. When the lock between the positioning pin 34 and the work rod 20 is released, the work rod 20 can work in conjunction with the pin 13 and thus to rotate relatively to the body 10.

Figure 4:
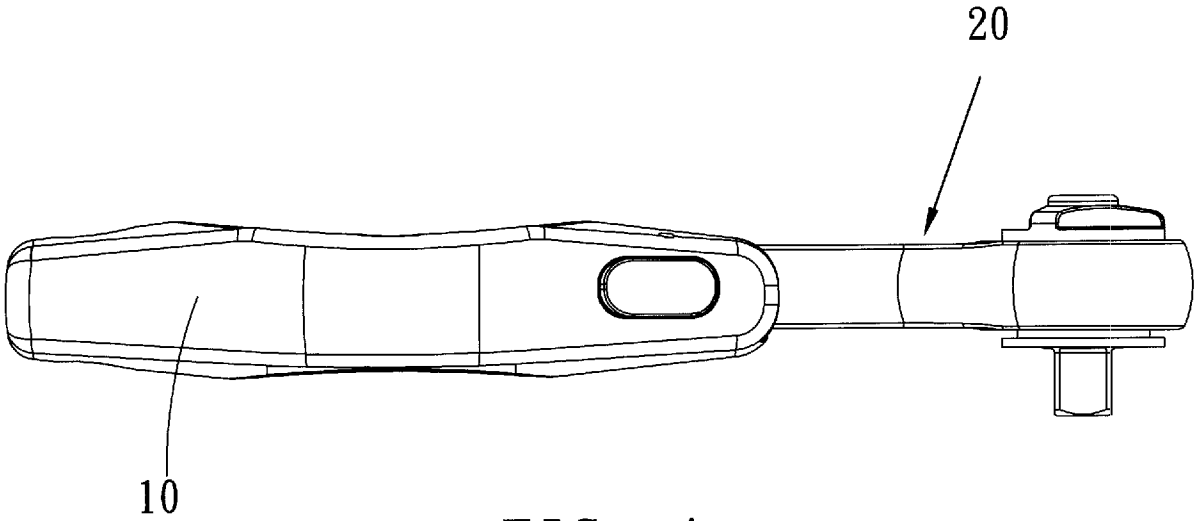
FIG. 4 is a schematic illustration showing a developed state of the invention.

As shown in FIG. 4 and according to the above-mentioned description of the operation, the work rod 20 and the body 10 can form the developed state.

Figure 5:
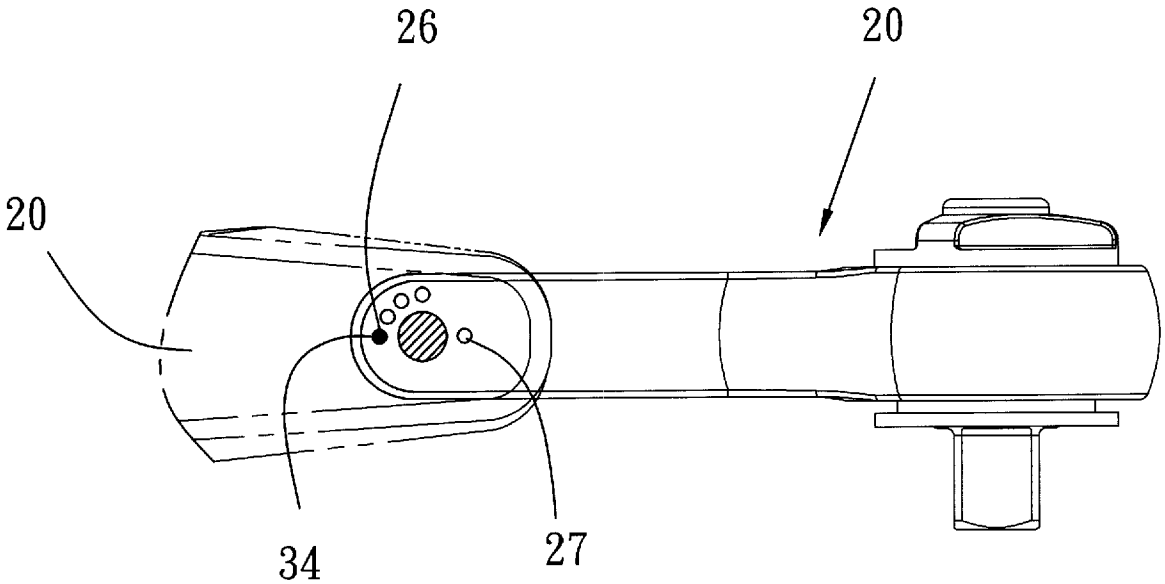
FIG. 5 is a schematic illustration showing the arrangement of the positioning pin and the development positioning hole in the developed state of the invention.

As shown in FIG. 5, when the work rod 20 and the body 10 form the developed state, the acting force on the press button (not shown) can be released so that the positioning pin 34 is moved toward the work rod 20 and embedded into the development positioning hole 26. Thus, the work rod 20 may form the positioning state to be used by the operator.

Figure 6:
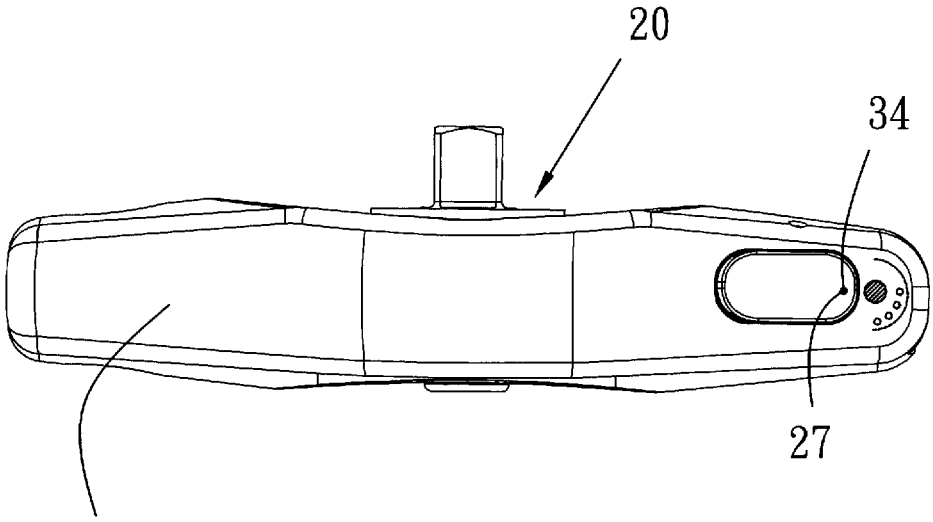
FIG. 6 is a schematic illustration showing a retracted state of the invention.

As shown in FIGS. 5 and 6, the lock between the positioning pin 34 and the work rod 20 can be released so that the work rod 20 is rotated and overlaps with the body 10. At this time, the positioning pin 34 can be embedded into the retraction positioning hole 27.

Figure 7:
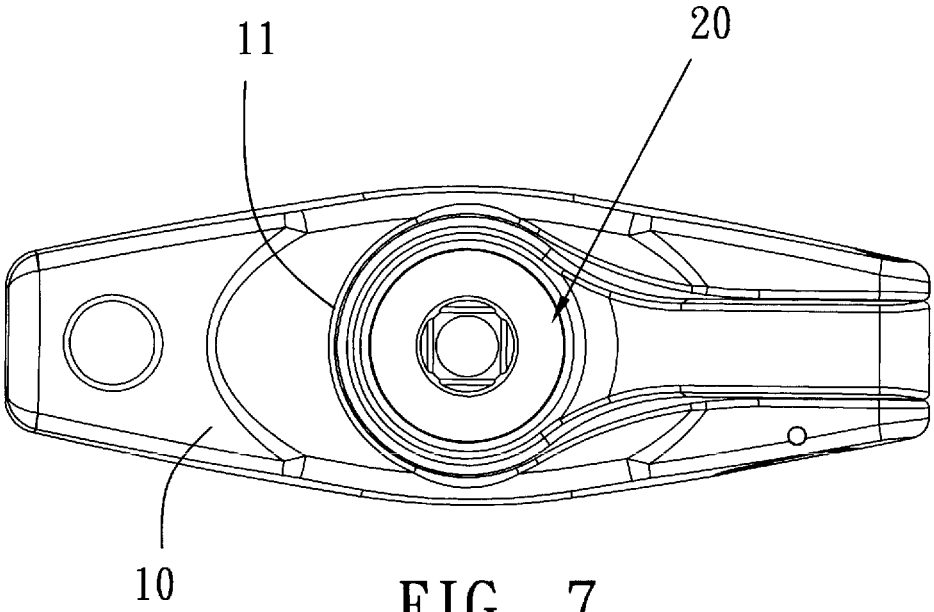
FIG. 7 is a schematic illustration showing the retracted state of the invention.

As shown in FIG. 7, the work rod 20 overlaps with the body 10 and is accommodated within the retraction receptacle 11.

Figure 9:
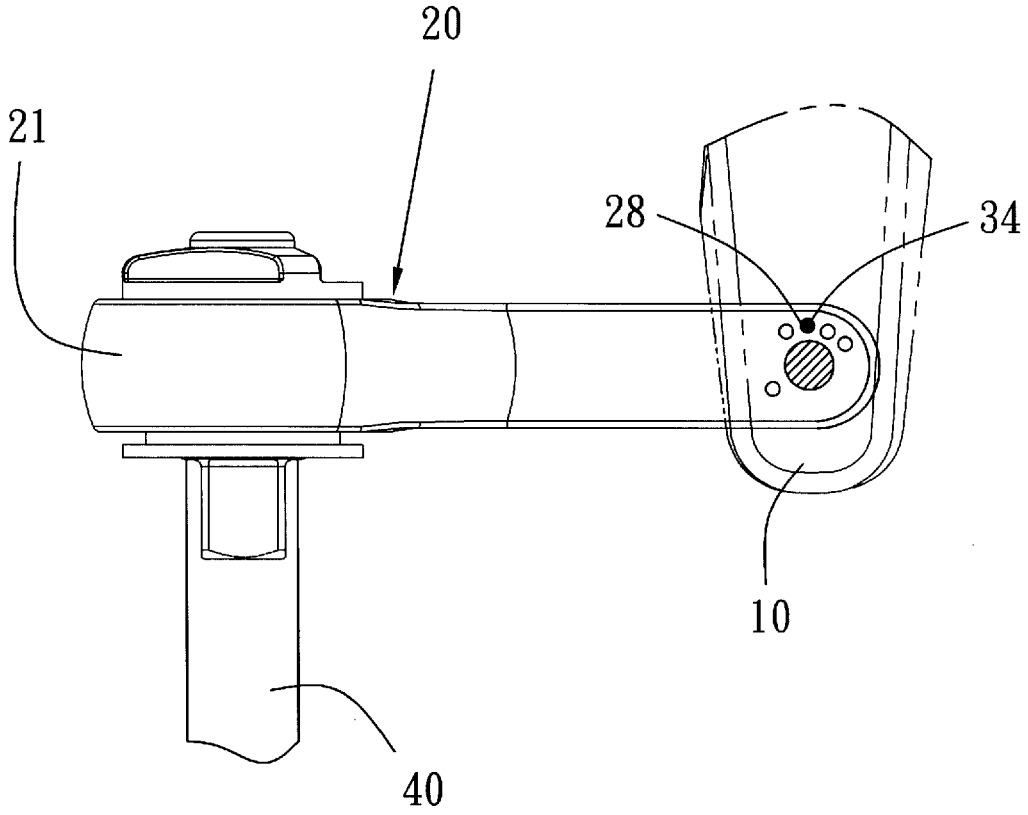
FIG. 9 is a schematic illustration showing the body and the work rod connected in the angled state and connected to the connection rod according to the invention.

As shown in FIG. 9, releasing the lock between the positioning pin 34 and the work rod 20 can make the work rod 20 rotate to a predetermined angle, and then make the positioning pin 34 be inserted into one of the angle positioning holes 28.

Figure 8:
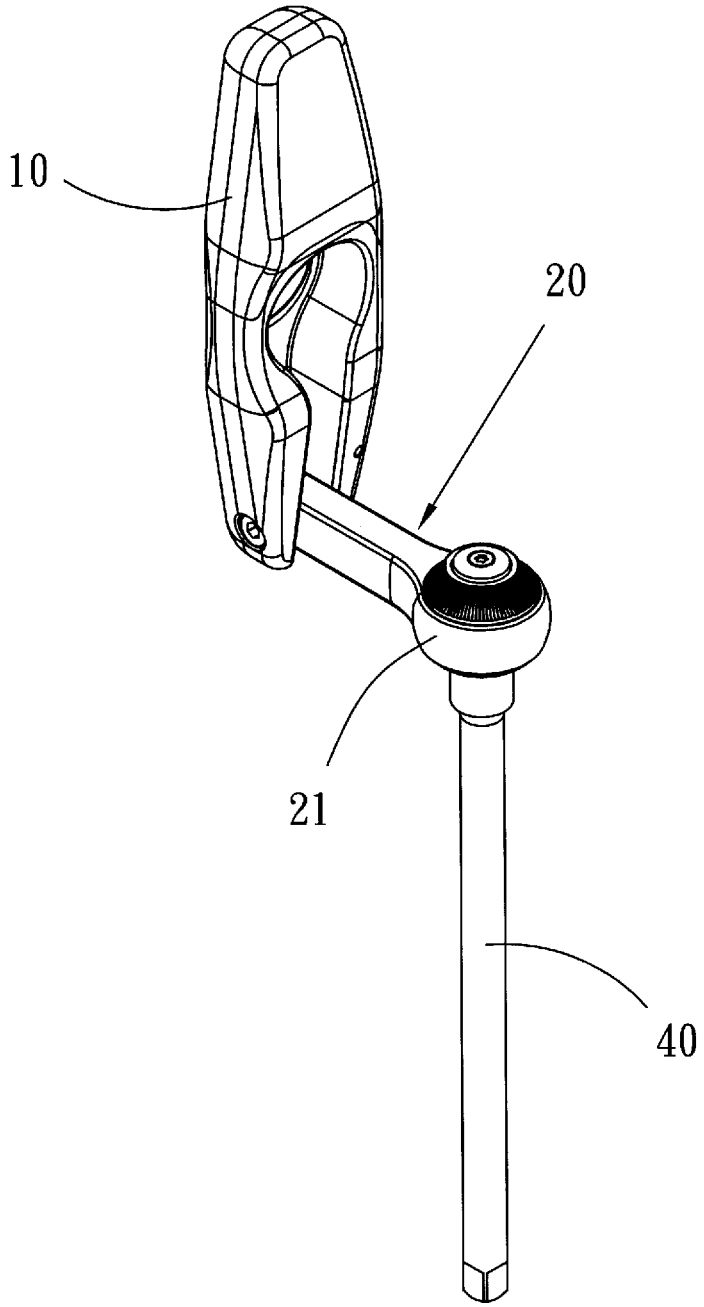
FIG. 8 shows the exterior of the body and the work rod connected in an angled state and connected to a connection rod according to the invention.

As shown in FIGS. 8 and 9, the work rod 20 and the body 10 may form an angled state. In addition, a connection rod 40 may be connected to the head 21 of the work rod 20. Thus, the operator can apply a torsion force to the body 10 more conveniently to rotate the connection rod 40 rapidly and satisfy the operation requirement at a special angle.

Figure 10:
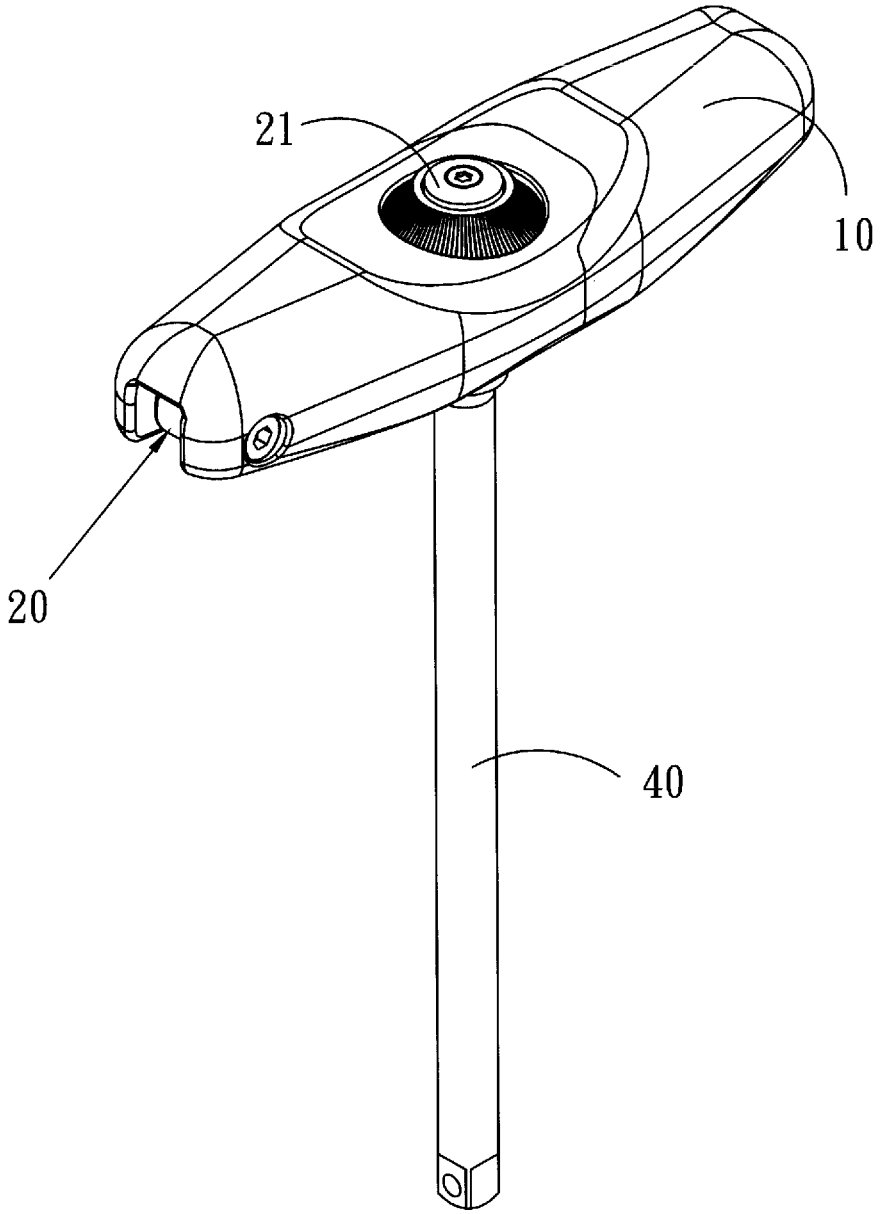
FIG. 10 shows the exterior of the body and the work rod stacked together and connected to the connection rod according to the invention.

As shown in FIG. 10, when the work rod 20 and the body 10 form the overlapped state, the head 21 of the work rod 20 can be connected to the connection rod 40. Thus, the operator can use the palm to hold the body 10 and apply a torsion force to rotate the body 10 and the connection rod 40.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. A multi-function tool structure, comprising:

a body;

a retraction receptacle, which is formed on the body and has one end having an open structure having two sidewalls;

a storage receptacle formed on an outer surface of one of the sidewalls of the open structure;

a slide hole, which is formed in the storage receptacle and communicates with the open structure;

a work rod having a rod portion and a head connected to one end of the rod portion, wherein the rod portion is mounted in the open structure of the body and has a development positioning hole and a retraction positioning hole disposed opposite the development positioning hole;

a press button pivotally mounted in the storage receptacle;

a compression spring, which is disposed in the storage receptacle and has one end in contact with the press button;

a positioning pin, which is disposed in the slide hole and has one end in contact with the press button and the other end that can be inserted into the retraction positioning hole or the development positioning hole; and a return spring, which is combined with the positioning pin and makes the positioning pin elastically movable, so that:

pressing the press button can release a lock between the positioning pin and the work rod, and make the work rod be retracted into the retraction receptacle of the body, or make the work rod and the body form a developed state; and releasing the press button can make the positioning pin be embedded into the retraction positioning hole or the development positioning hole to position the work rod.

2. The multi-function tool structure according to claim 1, further comprising a pin penetrating through the two sidewalls of the open structure and the rod portion of the work rod so that the work rod is rotatable, wherein the retraction positioning hole and the development positioning hole are disposed around the pin.

3. The multi-function tool structure according to claim 1, further comprising an accommodating slot disposed on a bottom surface of the storage receptacle, wherein the compression spring is disposed in the accommodating slot.

4. The multi-function tool structure according to claim 1, further comprising a plurality of angle positioning holes formed on the rod portion and disposed between the development positioning hole and the retraction positioning hole.

5. The multi-function tool structure according to claim 1, further comprising a bump portion formed in the storage receptacle, wherein the slide hole is formed on the bump portion.

6. The multi-function tool structure according to claim 1, further comprising a connection rod connected to the head of the work rod.

* * * * *